US010669619B2

(12) United States Patent
Mori et al.

(10) Patent No.: US 10,669,619 B2
(45) Date of Patent: Jun. 2, 2020

(54) TITANIUM ALLOY MEMBER AND METHOD FOR MANUFACTURING THE SAME

(71) Applicant: NIPPON STEEL & SUMITOMO METAL CORPORATION, Tokyo (JP)

(72) Inventors: Kenichi Mori, Tokyo (JP); Hideki Fujii, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 327 days.

(21) Appl. No.: 15/529,188

(22) PCT Filed: Nov. 30, 2015

(86) PCT No.: PCT/JP2015/083651
§ 371 (c)(1),
(2) Date: May 24, 2017

(87) PCT Pub. No.: WO2016/084980
PCT Pub. Date: Jun. 2, 2016

(65) Prior Publication Data

US 2017/0356076 A1 Dec. 14, 2017

(30) Foreign Application Priority Data

Nov. 28, 2014 (JP) ..... 2014-240841

(51) Int. Cl.
*C23C 8/14* (2006.01)
*C23C 14/00* (2006.01)
(Continued)

(52) U.S. Cl.
CPC ..... *C23C 8/24* (2013.01); *C22C 14/00* (2013.01); *C22F 1/02* (2013.01); *C22F 1/183* (2013.01);
(Continued)

(58) Field of Classification Search
CPC ..... C23C 8/24; C23C 14/00
See application file for complete search history.

(56) References Cited

FOREIGN PATENT DOCUMENTS

EP 0 905 271 3/1999
EP 0 931 848 7/1999
(Continued)

OTHER PUBLICATIONS

Machine Translation of JP 2002-097914 (Year: 2002).*
(Continued)

*Primary Examiner* — Scott R. Walshon
*Assistant Examiner* — Sathavaram I Reddy
(74) *Attorney, Agent, or Firm* — Clark & Brody LP

(57) ABSTRACT

There is provided a titanium alloy member including a base metal portion, and an outer hardened layer formed on an outer layer of the base metal portion, the cross sectional hardness of the base metal portion is 330 HV or higher and lower than 400 HV, the cross sectional hardnesses at positions 5 μm and 15 μm from the surface of the outer hardened layer are 450 HV or higher and lower than 600 HV, the outer hardened layer includes an oxygen diffusion layer and a nitrogen diffusion layer, the oxygen diffusion layer is at a depth of 40 to 80 μm from the surface of the outer hardened layer, and the nitrogen diffusion layer is at a depth of 2 to 5 μm from surface of the outer hardened layer. This titanium alloy member includes an outer hardened layer, is high in cross sectional hardness of the base metal portion, and is excellent in fatigue strength and wear resistance.

5 Claims, 1 Drawing Sheet

(51) Int. Cl.

| | |
|---|---|
| ***C23C 8/24*** | (2006.01) |
| ***C22C 14/00*** | (2006.01) |
| ***C23C 8/12*** | (2006.01) |
| ***C23C 8/34*** | (2006.01) |
| ***C23C 8/10*** | (2006.01) |
| ***C22F 1/02*** | (2006.01) |
| ***C22F 1/18*** | (2006.01) |
| ***C23C 8/16*** | (2006.01) |

(52) U.S. Cl.
CPC ..... *C23C 8/10* (2013.01); *C23C 8/12* (2013.01); *C23C 8/16* (2013.01); *C23C 8/34* (2013.01)

(56) References Cited

FOREIGN PATENT DOCUMENTS

| | | |
|---|---|---|
| EP | 1 225 353 | 7/2002 |
| EP | 2 078 760 | 7/2009 |
| EP | 2 103 707 | 9/2009 |
| JP | 53-120642 | 10/1978 |
| JP | 62-256956 | 11/1987 |
| JP | 06-136499 | 5/1994 |
| JP | 08-277459 | 10/1996 |
| JP | 2001-49421 | 2/2001 |
| JP | 2002-97914 | 4/2002 |
| JP | 3343954 | 11/2002 |
| JP | 2003-73796 | 3/2003 |
| JP | 2004-169128 | 6/2004 |
| JP | 2006-249508 | 9/2006 |
| JP | 2007-100666 | 4/2007 |
| JP | 2008-195994 | 8/2008 |
| JP | 2011-102414 | 5/2011 |
| JP | 2012-144775 | 8/2012 |
| JP | 2013-061075 | 4/2013 |
| JP | 2014-169496 | 9/2014 |
| WO | 2012/108319 | 8/2012 |

OTHER PUBLICATIONS

Machine Translation of JP 2006-249508 (Year: 2006).*
Machine Translation of JP H06-101006 (Year: 1994).*
Oyama et al., "Effects of Deformation . . . Forgoing for Ti—5Al—2Sn—2Zr—4Mo—4Cr (Ti-17)", R&D Kobe Steel Engineering Reports, Dec. 1, 1999, vol. 49, No. 3, pp. 23-25.

* cited by examiner

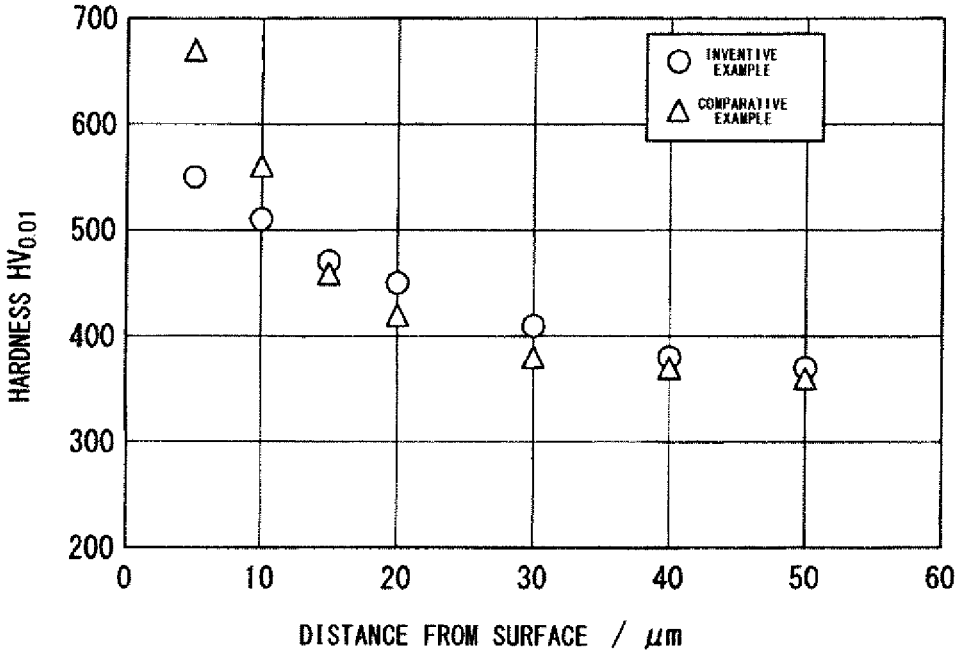
700
600
500
400
300
200
HARDNESS $HV_{0.01}$
0
10
20
30
40
50
60
DISTANCE FROM SURFACE / μm
INVENTIVE EXAMPLE
COMPARATIVE EXAMPLE

TITANIUM ALLOY MEMBER AND METHOD FOR MANUFACTURING THE SAME

TECHNICAL FIELD

The present invention relates to a titanium alloy member and a method for manufacturing a titanium alloy member.

BACKGROUND ART

Titanium alloys, which are lightweight, high in specific strength, and moreover excellent in heat resistance, are used in a wide variety of fields including aircrafts, automobiles, consumer products, and the like. A typical example of the titanium alloys is α+β Ti-6Al-4V. Out of α+β titanium alloys, an alloy containing a β stabilizing element in a relatively large quantity is called a β rich α+β titanium alloy or a Near-β titanium alloy, which is widely used as a high-strength titanium alloy.

Although the definition of the β rich α+β titanium alloy or the Near-β titanium alloy is not well-defined, it is an alloy of a α+β titanium alloy that contains a β stabilizing element in a large quantity to increase the ratio of a β phase. Hereinafter, it will be referred to as a Near-β titanium alloy. Typical examples of the Near-β titanium alloy include, but not limited to, Ti-10V-2Fe-3Al, Ti-6Al-2Sn-4Zr-6Mo, Ti-5Al-5V-5Mo-3Cr, and the like. In addition, titanium alloys such as Ti-5Al-2Fe-3Mo and Ti-4.5Al-3V-2Mo-2Fe are included in Near-β titanium alloys. Mo equivalent, which is used as an index indicating a β phase stability (Mo equivalent=Mo[mass %] V[mass %]/1.5+1.25×Cr[mass %]+2.5×Fe[mass %]) is within a range of about 6 to 14 for the alloys described above.

The strength and ductility of a Near-β titanium alloy can be changed by controlling the form of the microstructure thereof through thermo-mechanical treatment. However, an excessively increased strength of a Near-β titanium alloy leads to an increased notch susceptibility, which becomes a problem in terms of practice.

Meanwhile, a titanium alloy poses a problem of a poor wear resistance when used for a sliding portion as a component for an automobile. To improve the wear resistance of a titanium alloy member, various kinds of coating and techniques such as hardened layer formation have been developed. Coating is to form a hard ceramic or a metal on a surface of a titanium alloy member by a method such as physical vapor deposition (PVD) and spraying. Coating has not come into widespread use due to its high treatment costs.

As a method inexpensive and easy to use industrially, there is a method of forming a hardened layer on a surface of a titanium alloy starting material. For example, Patent Document 1 describes a method of forming an oxide scale on a surface of a product by performing heat treatment in an atmosphere furnace. Patent Document 2 discloses a surface treatment method for a titanium-based material by which an oxygen diffusion layer is formed without generating an oxide layer by performing oxygen diffusion treatment in an oxygen-poor atmosphere.

In the case of forming an oxidized layer or an oxygen diffusion layer by causing oxygen to diffuse from the surface into the inside of a titanium alloy starting material, an oxygen concentration of an outermost layer becomes extremely high. As a result, a fatigue fracture starting from a surface occurs in a titanium alloy member, which problematically reduces fatigue strength.

Thus, there have been studied various methods for suppressing the reduction in fatigue strength or obtaining a high fatigue strength, after forming an oxidized hardened layer.

For example, Patent Document 3 proposes a method for ensuring required fatigue strength and wear resistance by performing oxidation treatment at an oxidation treatment temperature and for a time satisfying conditions. Patent Document 3 discloses that making the thickness of an oxidized hardened layer 14 μm or smaller enables the reduction in a fatigue strength due to oxidation treatment to be suppressed to 20% or less.

Patent Document 4 discloses a titanium member that is subjected to oxidation treatment and then shotpeening. In Patent Document 4, oxidation treatment is performed to set a surface hardness Hmv at 550 or higher and lower than 800, shotpeening is then performed to set the surface hardness Hmv at 600 or higher and 1000 or lower, and the thickness of an oxygen diffusion layer is set at from 10 μm to 30 μm.

Patent Document 5 discloses a technique in which a carburized layer is formed on a surface of which wear resistance or fatigue strength is required, and then an oxidized layer is formed on a portion to come in contact with other valve train components.

Patent Document 6 describes a Near-β titanium alloy that is excellent in fatigue characteristics.

Patent Document 7 describes a titanium-alloy-made engine valve on a surface of which an oxygen diffusion layer is formed. Patent Document 8 describes an engine valve made of a high-strength titanium alloy for an automobile on a surface of which an oxidized hardened layer is formed. Patent Document 9 describes a titanium alloy member that includes an outer layer made of a titanium alloy base metal including a hardened layer in which oxygen is dissolved.

LIST OF PRIOR ART DOCUMENTS

Patent Document

Patent Document 1: JP62-256956A
Patent Document 2: JP2003-73796A
Patent Document 3: JP2004-169128A
Patent Document 4: JP2012-144775A
Patent Document 5: JP2001-49421A
Patent Document 6: JP2011-102414A
Patent Document 7: JP2002-97914A
Patent Document 8: JP2007-100666A
Patent Document 9: WO 2012/108319

SUMMARY OF INVENTION

Technical Problem

A titanium alloy used in Patent Document 3 is Ti-6Al-4V, which is not a material that stably provides a base-metal cross sectional hardness of 330 HV. In addition, a fatigue strength obtained in Patent Document 3 is limited to 400 MPa, which is not considered to be sufficiently high.

Setting a surface hardness at 600 or higher and 1000 Hv or lower, as with the titanium member of Patent Document 4, is advantageous to fretting wear resistance but liable to a considerable reduction in fatigue strength. In addition, a compressive residual stress imparted by shotpeening is released when an operating temperature of the member becomes about 300° C. or higher, which falls short of a stable processing method.

In Patent Document 5, the oxidized layer is formed by oxidizing an outer layer using flame of oxygen and a fuel gas such as acetylene. In such a method, it is difficult to apply the flame to only an appropriate region where the oxidized layer to be formed, and additionally, the complexity of a manufacturing method increases, which inevitably involves an increase in costs due to the reduction in production efficiency.

Patent Document 6 has no description about the wear resistance of a titanium alloy member.

In Patent Documents 7 to 9, what is formed on outer layer of a titanium alloy member is an oxidized hardened layer, which does not have a sufficient ductility, reducing fatigue strength.

In a conventional practice, forming an outer hardened layer by causing oxygen or carbon to diffuse from a surface to impart a wear resistance to a titanium alloy member involves a problem of a considerable reduction in fatigue strength as compared with the case of the absent of the outer hardened layer. Another problem is that the reduction in fatigue strength prevents required properties from being satisfied to use the titanium alloy member as driving components for an automobile such as a connecting rod and an engine valve.

An object of the present invention, which has been made in view of the circumstances described above, is to provide a titanium alloy member that has an outer hardened layer and a high cross sectional hardness of a base metal portion, and is excellent in fatigue strength and wear resistance, and to provide a method for manufacturing a titanium alloy member.

Solution to Problem

To solve the problems described above, the present inventors have conducted intensive researches into the relation between an outer hardened layer and a fatigue strength in a titanium alloy member having a high cross sectional hardness in a base metal portion. In particular, paying attention to an outermost-layer portion of the outer hardened layer that is prone to serve as a start point of the occurrence of a crack, the present inventors have studied a hardness distribution of the outer hardened layer in a depth direction while changing formation conditions such as changing a degree of vacuum and changing the kind of an atmospheric gas, a heat treatment temperature, and a heat treatment time, within a controllable range for a typical heat treatment furnace. Then, by reducing the hardness of the outermost-layer portion to control the hardness distribution of the outer hardened layer within a certain range, it is found that a titanium alloy member having a high cross sectional hardness in the base metal portion yields an excellent wear resistance and a high fatigue strength.

As mentioned above, outer hardened layers in prior art are formed by diffusion of oxygen and further diffusion of carbon. However, in such outer hardened layers, fatigue strength deteriorates even when the hardness of an outermost-layer portion is reduced to control the hardness distribution of the outer hardened layer within the certain range. Thus, the present inventors have conducted researches into components constituting the outer hardened layer and have consequently found that forming a nitrogen diffusion layer at a predetermined depth together with an oxygen diffusion layer at a predetermined depth yields an excellent wear resistance and a high fatigue strength even further.

The gist of the present invention is as follows.

[1] A titanium alloy member including a base metal portion, and an outer hardened layer formed on an outer layer of the base metal portion, the base metal portion having a cross sectional hardness of 330 HV or higher and lower than 400 HV, cross sectional hardnesses at positions 5 μm and 15 μm from a surface of the outer hardened layer being 450 HV or higher and lower than 600 HV, the outer hardened layer including an oxygen diffusion layer and a nitrogen diffusion layer, the oxygen diffusion layer being at a depth of 40 to 80 μm from the surface of the outer hardened layer, and the nitrogen diffusion layer being at a depth of 2 to 5 μm from the surface of the outer hardened layer.

[2] The titanium alloy member according to [1], wherein the base metal portion is made of a Near-β titanium alloy, and a chemical composition of the base metal portion contains, in mass %, Al: 3 to 6%, oxygen: 0.06% or more and less than 0.25%, Mo equivalent of 6 to 13%, which is calculated by a following formula (1), with the balance being Ti and impurities:

$$\text{Mo equivalent (\%)} = \text{Mo (\%)} + \text{V (\%)}/1.5 + 1.25\times\text{Cr (\%)} + 2.5\times\text{Fe (\%)} \quad (1)$$

where symbols of elements in the formula (1) indicate contents of respective elements in mass %.

[3] The titanium alloy member according to [1] or [2], wherein a microstructure of the base metal portion is an acicular structure including an acicular a phase precipitating in a β phase matrix and a grain boundary α phase precipitating along a crystal grain boundary of prior β phases.

[4] The titanium alloy member according to any one of [1] to [3], wherein the titanium alloy member is a member for an automobile.

[5] A method for manufacturing a titanium alloy member according to any one of [1] to [4], including: performing previous stage heat treatment on a starting material shaped into a member shape in an oxygen-contained atmosphere at 650 to 850° C. for 5 minutes to 12 hours; and after the previous stage heat treatment, performing subsequent stage heat treatment in a nitrogen atmosphere at 700 to 830° C. for 1 to 8 hours.

Advantageous Effects of Invention

According to the present invention, it is possible to provide a titanium alloy member having a high cross sectional hardness in a base metal portion, and having an outer hardened layer to be excellent in wear resistance, the titanium alloy member being smaller than conventional one in margin of the reduction in a fatigue strength due to the formation of an outer hardened layer, therefore having a high fatigue strength.

The titanium alloy member according to the present invention can be manufactured with a typical heat treatment furnace, and dispenses with the use of special device and gas, allowing industrially inexpensive manufacture.

The present invention provides the titanium alloy member having excellent wear resistance and fatigue strength, which finds a wide variety of applications of titanium products. For example, more titanium products, which are lightweight and have high-strength, can be used in driving members in automobiles such as two-wheel vehicles and four-wheel vehicles, which provides effects such as the improvement of fuel efficiency and the reduction of environmental loads, and allows for making a contribution to the realization of a sustainable society.

BRIEF DESCRIPTION OF DRAWINGS

FIG. 1 is a schematic diagram for illustrating a cross sectional hardness distribution of a titanium alloy member.

DESCRIPTION OF EMBODIMENTS

The present invention will be described below in detail.

The present inventor has studied as described below, intending compatibility between an excellent wear resistance and a fatigue strength in a titanium alloy member. Specifically, forming a titanium alloy member having an outer hardened layer by subjecting a titanium alloy to oxidation treatment results in a crack on the outer hardened layer, causing the deterioration of fatigue strength. It has been pointed out that how a crack forms in a titanium alloy member having an outer hardened layer includes: (1) a crack occurs in a brittle oxide scale layer formed on an outermost layer and propagates to a base metal; (2) a surface is coarsened through oxidation treatment, and a stress locally concentrates to generate a crack; (3) a brittle crack occurs by a tensile stress acting on an outer hardened layer subjected to oxygen dissolution to have an extremely decreased ductility. In particular, high-strength titanium alloys having tensile strengths of about 1000 MPa or higher have cross sectional hardnesses of about 330 HV or higher in their base metal portions. Therefore, the oxygen dissolution further increases the hardness of an outer hardened layer, which increases notch susceptibility. This intensifies the influence of an initially generated crack, whereby the fatigue strength is prone to decrease.

For example, in the case where a Ti-5Al-2Fe-3Mo-0.15 oxygen (O) alloy (a numeric value preceding each symbol of an element indicates the content of the element (mass %)), which is a Near-β titanium alloy, is shaped into a predetermined shape and subjected to heat treatment in the ambient air at 800° C. for one hour, the cross sectional hardness distribution of the titanium alloy member on which an outer hardened layer is formed is shown as a comparative example illustrated in FIG. 1. In the comparative example illustrated in FIG. 1, a cross sectional hardness at a position 5 μm from a surface exceeds 600 HV. In this case, the fatigue strength of the titanium alloy member decreases by about 30% as compared with the case of forming no outer hardened layer. This is estimated that the outer hardened layer having a hardness of 600 HV or higher lacks ductility necessary to suppress the propagation of a fine crack generated on the surface of the titanium alloy member, which makes the crack prone to propagate.

By performing the heat treatment to form an outer hardened layer at lower temperature or for a shorter time, the cross sectional hardness at a position 5 μm from a surface can be made lower than 600 HV, which allows the suppression of a decrease in fatigue strength. However, in this case, it is difficult to make a cross sectional hardness at a position 15 μm from a surface 450 HV or higher, which cannot produce an effect of improving wear resistance by forming an outer hardened layer.

As seen from the above, even performing normal heat treatment in the ambient air on the Ti-5Al-2Fe-3Mo-0.15O alloy cannot control hardnesses at a positions 5 μm and 15 μm from a surface, within a range from 450 HV or higher and lower than 600 HV, and thus it is difficult to provide compatibility between a wear resistance and a fatigue strength.

Here, the reason that positions for measuring cross sectional hardnesses at positions 5 μm and 15 μm from a surface is as follows. When a fine crack occurring on an outer hardened layer is smaller than 5 μm, the crack stays without propagating. Therefore, it is important to set a hardness at a position 5 μm from a surface at a certain value or smaller. In addition, when a cross sectional hardness at a position 15 μm from a surface is lower than 450 HV, an outer hardened layer is easily lost due to abrasion of a titanium alloy member in use, which makes the wear resistance insufficient.

In contrast, a method for manufacturing a titanium alloy member according to the present invention uses in the heat treatment an oxygen-contained gas such as ambient air and nitrogen gas, which are easy to handle in a typical heat treatment furnace. To cause oxygen and/or nitrogen gas atoms to diffuse from the surface into the inside of a titanium alloy, the concentration distribution of diffusing atoms is generally high in an outermost surface and reduces toward the inside because a diffusion velocity inside the titanium alloy is limited. This concentration distribution of diffusing atoms cannot be changed only by simply reducing the partial pressures of the oxygen gas or the nitrogen gas in the outside.

Thus, the present inventors have conducted intensive studies and have found a method for controlling a hardness distribution in an outer hardened layer by making use of the fact that the diffusion velocity of nitrogen is very low as compared with the diffusion velocity of oxygen at a temperature within a range from about 650° C. to 850° C., which is a practical temperature of final heat treatment for titanium alloys.

Specifically, for example, the Ti-5Al-2Fe-3Mo-0.15 oxygen (O) alloy is shaped into a predetermined shape and subjected to previous stage heat treatment in an oxygen-contained atmosphere at 650 to 850° C. for 5 minutes to 12 hours, and thereafter subjected to subsequent stage heat treatment in a nitrogen atmosphere at 700 to 830° C. for 1 to 8 hours. This yields, as in the present invention illustrated in FIG. 1, a hardness distribution that has a gentle concentration gradient and a reduced hardness of an outermost-layer portion in an outer hardened layer as compared with the comparative example illustrated in FIG. 1.

In the studies described above, as a base metal of the titanium alloy member, the Ti-5Al-2Fe-3Mo-0.15O alloy is used, which is a Near-β titanium alloy. The cross sectional hardness of a base metal portion made of the Ti-5Al-2Fe-3Mo-0.15O alloy differs according to its microstructure, roughly ranging from 330 to 400 HV. As a result of the studies conducted by the present inventors, it is found that the hardness distribution of an outer hardened layer can be controlled by applying the method described above even when the components of a base metal portion differ, as long as a high-strength titanium alloy member has a cross sectional hardness of 330 HV or higher and lower than 400 HV in the base metal portion.

Next, description will be made in detail about the titanium alloy member and a method for manufacturing the titanium alloy member according to the present invention.

The titanium alloy member according to the present invention includes a base metal portion and an outer hardened layer formed on an outer layer of the base metal portion. The base metal portion has a cross sectional hardness of 330 HV or higher and lower than 400 HV. The outer hardened layer has a cross sectional hardness of 450 HV or higher and lower than 600 HV at positions 5 μm and 15 μm from its surface.

A cross sectional hardness of the base metal portion of lower than 330 HV leads to an insufficient hardness of the base metal portion, resulting in an insufficient strength of the titanium alloy member. In addition, a cross sectional hardness of the base metal portion of 400 HV or higher results in an insufficient fatigue strength of the titanium alloy member.

Cross sectional hardnesses of the outer hardened layer of lower than 450 HV at positions 5 μm and 15 μm from the surface results in an insufficient wear resistance. In addition, cross sectional hardnesses of the outer hardened layer of 600 HV or higher at positions 5 μm and 15 μm from the surface results in an insufficient fatigue strength.

The hardnesses of the base metal portion and the outer hardened layer of the titanium alloy member in the present invention is measured by a method described blow.

A cross section of the member is subjected to mirror polish before the hardnesses of the base metal portion and the outer hardened layer are measured using a micro-Vickers durometer. As the hardness of the outer hardened layer, a micro-Vickers hardness under a 10 gf load is measured at positions 5 μm and 15 μm from the surface of the member. As the hardness of the base metal portion, a micro-Vickers hardness under a 1 kgf load is measured at a position 200 μm or longer from the surface of the member, which is free from the influence of the outer hardened layer.

In the present invention, the outer hardened layer includes an oxygen diffusion layer and a nitrogen diffusion layer, the oxygen diffusion layer being at a depth of 40 to 80 μm from the surface of the outer hardened layer, the nitrogen diffusion layer being at a depth of 2 to 5 μm from the surface of the outer hardened layer.

Here, when the contents of Al, O, and N increase, which are elements strengthening a phases of a titanium alloy, planar slip deformation occurs, in other words, slip deformation is prone to concentrate on a certain slip plane. In fatigue fracture, unevenness develops on a surface on which the planar slip deformation and the surface of a member intersect, where a crack is prone to occur. The present inventors have found that forming an outer hardened layer with an oxygen diffusion layer and a nitrogen diffusion layer, rather than forming an outer hardened layer with only an oxygen diffusion layer, suppresses the occurrence of an initial crack on the surface of a member, leading to the improvement of fatigue life.

When the oxygen diffusion layer is at a depth of smaller than 40μ from the surface of the outer hardened layer, the outer hardened layer lacks a thickness necessary for wear resistance. On the other hand, when the oxygen diffusion layer is at a depth of larger than 80 μm, the outer hardened layer becomes large in thickness, which makes an occurrence depth of an initial crack large, decreasing its fatigue strength. When the nitrogen diffusion layer is at a depth of smaller than 2μ from the surface of the outer hardened layer, an effect of suppressing plane slip deformation becomes insufficient, and when the nitrogen diffusion layer is at a depth of larger than 5 μm, the effect is saturated.

The base metal portion is preferably made up of a Near-β titanium alloy. The Near-β titanium alloy is an alloy having a relatively high ratio of β phases among α+β alloys, consisting of α phases and β phases. With the base metal portion being a Near-β titanium alloy enables, it is possible to easily obtain the effect of solid-solution strengthening by adding a β stabilizing element, as well as precipitation strengthening in which α phases are caused to precipitate in a β phase matrix.

The Near-β titanium alloy preferably has a chemical composition containing, in mass %, Al: 3 to 6%, oxygen (O): 0.06% or more and less than 0.25%, Mo equivalent of 6 to 13%, which is calculated by the following formula (I), with the balance being Ti and impurities:

$$\text{Mo equivalent (\%)} = \text{Mo (\%)} + \text{V (\%)}/1.5 + 1.25\times\text{Cr (\%)} + 2.5\times\text{Fe (\%)} \quad (1)$$

where symbols of elements in the formula (1) indicate the contents of the respective elements in mass %.

A content of Al of less than 3% may lead to an insufficient fatigue strength. Therefore, the content of Al is preferably 3% or more, more preferably 4% or more. In addition, a content of Al exceeding 6% leads to an increased ratio of α phases, making it difficult to obtain fine a phases, which may result in a decreased fatigue strength. Consequently, the content of Al is preferably 6% or less, more preferably 5.5% or less.

A content of oxygen of less than 0.06% may lead to an insufficient fatigue strength. Therefore, the content of oxygen is preferably 0.06% or more, more preferably 0.12% or more. In addition, a content of oxygen of 0.25% or more may leads to a decreased ductility, resulting in a failure to secure a sufficient toughness. Consequently, the content of oxygen is preferably less than 0.25%, and a more preferable content of oxygen is 0.18% or less.

A Mo equivalent of less than 6% makes it difficult to obtain fine a phases, resulting in a decreased fatigue strength. Therefore, the Mo equivalent is preferably 6% or more, more preferably 7% or more. In addition, a Mo equivalent exceeding 13% leads to an excessively high hardness, which may result in a failure to secure a sufficient toughness. Consequently, the Mo equivalent is preferably 13% or less, more preferably 13% or less.

It suffices that the Near-β titanium alloy contains one or more kinds of elements selected from Mo, V, Cr, and Fe that make the Mo equivalent calculated by the formula (1) fall within a range from 6 to 13%. Mo may be 13% or less, V may be 19.5% or less, Cr may be 10.4% or less, and Fe may be 5.2% or less. All the contents of the elements may be set at 0% as their lower limits. In addition, preferable upper limits are 6.0% for Mo, 6.0% for V, 4.0% for Cr, and 10% for Fe. The impurities may contain Si, C, N, and the other elements. When Si is less than 0.5%, C is less than 0.1%, and N is less than 0.1%, they has no influence on the effects of the present invention.

Next, the microstructure of the base metal portion will be described.

The microstructure of the base metal portion is preferably an acicular structure including acicular α phases precipitating in a β phase matrix and grain boundary α phases precipitating in acicular forms along crystal grain boundaries of prior β phases.

A microstructure of the base metal portion having an acicular structure allows for suppressing the deformation of a member shape in previous stage heat treatment and subsequent stage heat treatment to form an outer hardened layer, which will be described later. This is because a titanium alloy member in which a base metal portion has an acicular structure as its microstructure is excellent in creep resistance as compared with that in which a base metal portion has an equiaxed structure as its microstructure.

The acicular α phase preferably has a width within a range from 0.1 μm to 3 μm. A width of the acicular α phase falling within the range allows a more preferably creep property to be obtained. In addition, it is more desirable that the acicular α phase has a width of 1 μm or smaller. A width of the acicular α phase of 1 μm or smaller allows the suppression of a fatigue fracture that starts from a grain boundary α phase, which provides a more excellent fatigue strength.

The acicular α phase precipitates across a crystal grain of a prior β phase. Therefore, it is difficult to specify the length of an acicular α phase, and it is difficult to limit the aspect ratio of an acicular α phase.

In the titanium alloy member according to the present invention, the microstructure of the base metal portion is not limited to an acicular structure consisting of acicular α phases and grain boundary a phases, and may be, for example, an equiaxed structure, which is a micro-structure consisting of isometric pro-eutectoid α phases and transformed β phases. The transformed β phase means a collective name of micro-structures including α phases precipitating in a β grain in a cooling process that have been β phases in heat treatment at high temperature.

Next, a method for manufacturing a titanium alloy member according to the present invention will be described.

First, a titanium alloy having a predetermined alloy composition is melted by the vacuum arc remelting (VAR) method, and subjected to hot working, solution treatment, annealing, aging treatment, cutting, and the like to obtain predetermined member shape and microstructure.

The shape of a titanium alloy member manufactured in the present embodiment is not limited in particular. In addition, the shape of a starting material to be shaped into a member shape is suitable for the shape of an intended product and is not limited in particular.

In the present embodiment, to obtain the acicular structure described above including acicular α phases and grain boundary α phases as the microstructure of the base metal portion, the titanium alloy member is preferably retained at a β transformation point or higher in solution treatment. In addition, after the solution treatment retaining the titanium alloy member at the β transformation point or higher, the titanium alloy member is preferably cooled at a cooling rate of 1° C./s to 4° C./s. When the cooling rate after the solution treatment is 1° C./s or higher, the width of acicular α phases in the microstructure of the base metal portion becomes 1 μm or smaller. In addition, when the cooling rate after the solution treatment exceeds 4° C./s, the risk of deforming the member shape is increased in the subsequent annealing, aging treatment, previous stage heat treatment, and subsequent stage heat treatment. Therefore, the cooling rate is preferably 4° C./s or lower.

In the present embodiment, in the case of manufacturing a titanium alloy member having an equiaxed structure as the microstructure of the base metal portion, the titanium alloy member is preferably retained in the solution treatment at a temperature in a two-phase region of the α phase and the β phase. In this case, to refine α phases precipitating in β phases, the titanium alloy member is preferably cooled after the solution treatment at a cooling rate of 5 to 50° C./s.

The microstructure of the base metal portion of a titanium alloy member is formed in the solution treatment and in the cooling after the solution treatment, and is not influenced by the previous stage heat treatment and subsequent stage heat treatment thereafter performed, which will be described later. The solution treatment may be performed in an ambient air atmosphere or may be performed in vacuum or an Ar atmosphere to prevent the oxidation of the member.

In the present embodiment, the annealing or the aging treatment subsequent to the solution treatment can be substituted with the previous stage heat treatment and/or the subsequent stage heat treatment to form an outer hardened layer, which will be described later.

In the present embodiment, the starting material worked to have a predetermined microstructure and a predetermined member shape is subjected to the previous stage heat treatment using a heat treatment furnace or the like. The previous stage heat treatment is performed in an oxygen-contained atmosphere at 650 to 850° C. for 5 minutes to 12 hours. By performing the previous stage heat treatment, oxygen diffuses into the member. The concentration distribution of oxygen diffusing in the previous stage heat treatment shows that an oxygen concentration is the highest in the outermost layer of the member and decreases away from the surface of the member.

If heat treatment is performed at high temperature and for a long time exceeding the range of conditions for the previous stage heat treatment, so as to form a thick oxide scale layer on the surface of the member, the oxide scale layer serves as a source of oxygen in the subsequent stage heat treatment, which makes an oxygen blocking mechanism by a nitrogen gas difficult to work.

Meanwhile, even when an α case (oxygen-enriched layer) is generated in the previous stage heat treatment, the a case inevitably appearing in an oxygen-enriched titanium alloy, the amount of oxygen in the oxygen-enriched layer is small, which is thus estimated to have no influence on the oxygen blocking mechanism in the previous stage heat treatment.

The period of the previous stage heat treatment is preferably changed in accordance with a heat treatment temperature. Specifically, as a guide, the period is 12 hours at 650° C., 3 hours at 700° C., 1 hour at 750° C., 20 minutes at 800° C., and 8 minutes at 850° C., for example. The heat treatment temperature and the heat treatment time in the previous stage heat treatment are preferably 700 to 800° C. and 20 minutes to 3 hours, more preferably 720 to 780° C. and 30 to 90 minutes.

If the heat treatment temperature is lower than 650° C. and/or the heat treatment time is shorter than 5 minutes in the previous stage, the amount of oxygen diffusing in the member runs short. If the heat treatment temperature exceeds 850° C. and/or the heat treatment time exceeds 12 hours in the previous stage, the cross sectional hardness at a position 5 μm from the surface of the outer hardened layer becomes 600 HV or higher even when the subsequent stage heat treatment is performed, resulting in an insufficient fatigue strength. The oxygen-contained atmosphere in the previous stage heat treatment can be ambient air.

In the present embodiment, the member having subjected to the previous stage heat treatment may be positively cooled or may be retained in the heat treatment furnace without positively cooled. The cooling rate after the previous stage heat treatment have no influence on the microstructure of the base metal portion of the titanium alloy member and the properties of the titanium alloy member.

After the previous stage heat treatment and before the subsequent stage heat treatment, the oxygen-contained atmospheric gas is preferably evacuated from the heat treatment furnace in which the heat treatment is performed to generate a vacuum in the heat treatment furnace (evacuation process). The evacuation in the evacuation process is preferably performed using an oil rotary pump or the like to produce a degree of vacuum of $1\times10^{-2}$ Torr or lower.

Next, as the subsequent stage heat treatment, heat treatment is performed in a nitrogen atmosphere at 700 to 830° C. for 1 to 8 hours. The heat treatment temperature and the heat treatment time in the subsequent stage heat treatment are preferably 720 to 780° C. and 2 to 6 hours.

By performing the subsequent stage heat treatment, oxygen diffuses into in an inward direction of the member. Accordingly, the oxygen concentration in the outermost-layer portion is reduced and the concentration gradient of oxygen becomes gentle.

If the heat treatment temperature is lower than 700° C. and/or the heat treatment time is shorter than 1 hour in the subsequent stage, the cross sectional hardness at a position 5 μm from the surface of the outer hardened layer becomes 600 HV or higher even when the subsequent stage heat treatment is performed, resulting in an insufficient fatigue strength. In addition, if the heat treatment temperature in the subsequent stage exceeds 830° C., the microstructure is coarsened, resulting in a decreased fatigue strength. In addition, if the heat treatment time exceeds 8 hours in the subsequent stage, a cross sectional hardness at a position 15 μm from the surface of the outer hardened layer becomes lower than 450 HV, resulting in an insufficient wear resistance.

The reasons that the atmosphere in the subsequent stage heat treatment is the nitrogen atmosphere includes (1) to reduce a partial pressure of oxygen, (2) to suppress new oxygen penetration by using nitrogen, which occupies the same lattice location as that of oxygen and has a diffusion velocity lower than that of oxygen, and (3) the fact that the heat treatment temperature and the heat treatment time described above are not sufficient to increase the hardnesses at positions 5 μm and 15 μm from the surface to 600 HV or higher because the diffusion velocity of nitrogen is low. Furthermore, one of the reasons is that (4) forming an outer hardened layer with an oxygen diffusion layer and a nitrogen diffusion layer, rather than with only an oxygen diffusion layer, suppresses the occurrence of an initial crack on the surface of the member, leading to the improvement of fatigue life.

The subsequent stage heat treatment is performed with a high-purity nitrogen gas blowing or with a nitrogen gas atmosphere surrounding the member. The nitrogen gas used is one having a purity of 99.999% or higher. This is because a nitrogen gas of a low purity of nitrogen makes the base metal prone to absorb oxygen due to oxygen contained in the nitrogen gas as an impurity.

When the heat treatment temperatures are the same in the previous stage heat treatment and the subsequent stage heat treatment, the previous stage heat treatment and the subsequent stage heat treatment may be performed successively in the same furnace without decreasing the temperature. For example, the previous stage heat treatment may be performed in the ambient air, the evacuation process to exhaust the ambient air may be performed with the member staying in the furnace at a high temperature, and then a nitrogen gas may be blown into the furnace to make a nitrogen atmosphere.

The titanium alloy member obtained in such a manner is manufactured by performing the previous stage heat treatment and the subsequent stage heat treatment, and thus the cross sectional hardnesses of the base metal portion and the outer hardened layer fall within the range described above, which makes the titanium alloy member excellent in fatigue strength and wear resistance. Therefore, the titanium alloy member is suitably applicable to members for automobiles such as driving components of an automobile.

By the method for manufacturing a titanium alloy member according to the present embodiment, the hardness distribution of an outer hardened layer can be controlled, and thus it is possible to impart an excellent fatigue strength property to a titanium alloy member having a high cross sectional hardness in its base metal portion and including an outer hardened layer.

EXAMPLE

Now, the present invention will be described further specifically with reference to Examples.

Experimental Example 1

A titanium alloy having an alloy composition of Ti-5% Al-2% Fe-3% Mo-0.15% oxygen (O) was melted by the vacuum arc remelting (VAR) method, and subjected to forging and heat rolling, so that a barstock having a diameter of ϕ15 mm was manufactured. The obtained barstock was subjected to solution treatment in which the barstock was heated in the ambient air at 1050° C. for 20 minutes, and subjected to air cooling at temperatures of from 1050 to 700° C. at a cooling rate of 0.1 to 4° C./s, so that the microstructure of a base metal portion is developed. The cooling rate after the solution treatment is calculated using the temperature of a cross-sectional center portion measured with a thermocouple in a hole having a diameter of 2 mm opened in the barstock.

From the barstock having the microstructure developed in such a manner, fatigue test specimens each including a parallel portion of ϕ4 mm×8 mm length and flat plate specimens having dimensions of 2 mm×10 mm×10 mm were fabricated, and the parallel portions of the fatigue test specimens and the surface of the flat plate specimens were abraded with #1000. Subsequently, the fatigue test specimens and the flat plate specimens were subjected to the previous stage heat treatment and the subsequent stage heat treatment in this order under conditions shown in Table 1, so that an outer hardened layer was formed on the entire surface of an outer layer of each fatigue test specimen and flat plate specimen.

Next, using part of the fatigue test specimen on which the outer hardened layer was formed, the cross sectional hardnesses of the base metal portion and the outer hardened layer were measured using a micro-Vickers durometer. First, the parallel portion of the fatigue test specimen was cut off and embedded in resin, and a cross section was subjected to mirror polish. Next, a micro-Vickers hardness under a 10 gf load was measured at positions 5 μm and 15 μm from a surface. In addition, as the hardness of the base metal portion, a micro-Vickers hardness under a 1 kgf load is measured at a position 200 μm or longer from a surface.

Next, using a glow discharge emission spectrophotometer (GDS), distributions of oxygen and nitrogen were measured up to a depth of 100 μm from the surface of the flat plate specimen subjected to the treatment as with the fatigue test specimen. An analytical intensity level in the vicinity of a depth of 100 μm where analytical intensities of oxygen and nitrogen become unchanged was determined as the base metal levels of oxygen and nitrogen. The depths of the oxygen diffusion layer and the nitrogen diffusion layer were determined as depths at which the analytical intensities of oxygen and nitrogen decrease to their respective base metal levels.

In addition, for the fatigue test specimen on which the outer hardened layer was formed, a fatigue strength and an abrasive resistance were evaluated by the method described below.

Evaluation of Fatigue Strength

A rotating bending fatigue test at 3600 rpm was conducted in the ambient air at room temperature, a stress with which the fatigue test specimen remained unruptured even after $1\times10^7$ rotations was measured and determined as a fatigue strength. Having a fatigue strength of 450 MPa or higher was set as a benchmark, and a fatigue test specimen satisfying the benchmark was evaluated to be good.

Evaluation of Abrasive Resistance

An abrasive resistance was evaluated based on whether or not a crack is present on the surface of a fatigue test specimen after $1\times10^7$ of excitations that was performed by colliding a SCM435 member (JIS G4053, a chromium molybdenum steel material) with the surface under the conditions of a load of 98 N (10 kgf) and an oscillation frequency of 500 Hz, with a tensile load of 300 MPa applied on the fatigue test specimen in an axis direction. Having no crack on the surface after the $1\times10^7$ of excitations was set as a benchmark, a fatigue test specimen satisfying the benchmark was evaluated to be accepted "O", and a fatigue test specimen not satisfying the benchmark was evaluated to be rejected "x".

In addition, for the fatigue test specimen on which an outer hardened layer was formed, its microstructure was checked by the method described below.

Evaluation of Microstructure

Under an optical microscope, a cross section of a base metal portion of a fatigue test specimen was observed at 500× magnification. The number of visual fields to be observed was set at ten.

A microstructure being an acicular structure that includes acicular α phases and grain boundary α phases was evaluated to be an acicular structure. The width of the acicular α phases was calculated by a method in which the total width of a plurality of parallel α phases was divided by the number of the acicular α phases. To be exact, β phases are interposed between the parallel α phases, but the thicknesses of the β phases are extremely small, and thus the evaluation was simplified.

A micro-structure consisting of isometric pro-eutectoid α phases and transformed β phases that are obtained by performing heat treatment in a two-phase region of the α phase and the β phase was evaluated to be an equiaxed structure. The grain size of an equiaxed structure was calculated by the intercept method with pro-eutectoid α phases and transformed β phases regarded as individual grains.

Table 1 shows temperatures and times for the previous stage heat treatment and the subsequent stage heat treatment, the cross sectional hardnesses at positions 5 μm and 15 μm from the surface of the base metal portion, and the results of evaluations on fatigue strength and wear resistance, microstructure, and the width of acicular α phases.

TABLE 1

| | PREVIOUS STAGE HEAT TREATMENT | | SUBSEQUENT STAGE HEAT TREATMENT | | BASE METAL PORTION HARDNESS | NEAR-SURFACE PORTION HARDNESS | | OXYGEN DIFFUSION | NITROGEN DIFFUSION | MICRO | WIDTH OF ACICULAR | FATIGUE | WEAR | |
|---|---|---|---|---|---|---|---|---|---|---|---|---|---|---|
| | TEMP. ° C. | TIME h | TEMP. ° C. | TIME h | HV | 5 μm HV | 15 μm HV | DEPTH μm | DEPTH μm | STRUCTURE | PHASE μm | STRENGTH MPa | RESISTANCE | NOTE |
| 1 | 750 | 1 | 750 | 3 | 345 | 550 | 470 | 57 | 4.1 | ACICULAR | 0.6 | 500 | ○ | INVENTIVE EXAMPLE |
| 2 | 720 | 1.5 | 750 | 4 | 345 | 515 | 455 | 58 | 4.7 | ACICULAR | 0.7 | 540 | ○ | |
| 3 | 760 | 0.5 | 750 | 4 | 355 | 530 | 455 | 60 | 4.7 | ACICULAR | 0.8 | 520 | ○ | |
| 4 | 650 | 12 | 700 | 8 | 380 | 565 | 460 | 56 | 3.4 | ACICULAR | 0.5 | 460 | ○ | |
| 5 | 700 | 3 | 700 | 8 | 370 | 555 | 450 | 52 | 3.4 | ACICULAR | 0.6 | 500 | ○ | |
| 6 | 750 | 1 | 720 | 6 | 345 | 550 | 460 | 58 | 4.0 | ACICULAR | 0.7 | 500 | ○ | |
| 7 | 800 | 0.33 | 750 | 4 | 355 | 520 | 450 | 66 | 4. | ACICULAR | 0.8 | 540 | ○ | |
| 8 | 850 | 0.13 | 600 | 1 | 345 | 560 | 460 | 56 | 4.3 | ACICULAR | 1.2 | 470 | ○ | |
| 9 | 780 | 1 | 780 | 2 | 335 | 585 | 490 | 77 | 4.9 | ACICULAR | 2.5 | 460 | ○ | |
| 10 | 620 | 12 | 780 | 1.5 | 355 | 490 | 420* | 48 | 4.3 | ACICULAR | 0.7 | 550 | X | COMPARATIVE EXAMPLE |
| 11 | 750 | 1 | 670 | 8 | 380 | 590 | 410* | 58 | 2.2 | ACICULAR | 0.6 | 460 | X | |
| 12 | 750 | 2 | 820 | 0.25 | 345 | 680* | 470 | 66 | 2.9 | ACICULAR | 0.9 | 340 | ○ | |
| 13 | 750 | 1 | 750 | 0.5 | 350 | 640* | 680* | 45 | 1.8 | ACICULAR | 0.8 | 400 | X | |
| 14 | 800 | 0.33 | 800 | 4 | 330 | 580 | 460 | 50 | 12* | ACICULAR | 2.8 | 330 | ○ | |
| 15 | 750 | 1 | 750 | 2 | 350 | 570 | 450 | 37* | 3.6 | ACICULAR | 0.7 | 480 | X | |
| 16 | 800 | 1 | — | — | 360 | 670* | 460 | 32* | —* | ACICULAR | 0.8 | 330 | ○ | |
| 17 | 800 | 1 | — | — | 340 | 380* | 360* | —* | 4.7* | ACICULAR | 0.8 | 480 | X | |
| 18 | 750 | 1 | 750 | 3 | 345 | 540 | 465 | 55 | —* | ACICULAR | 0.8 | 420 | ○ | |
| 19 | 600 | 20 | 800 | 36 | 325* | 600* | 470 | —* | 44* | ACICULAR | 5.0 | 320 | ○ | |

The mark "*" indicates it does not meet the claimed range.

Nos. 1 to 9 are example embodiments of the present invention. As to Nos. 1 to 9, the cross sectional hardnesses at positions 5 μm and 15 μm from the surface were 450 to 585 HV, the depth of the oxygen diffusion layer from the surface of the outer hardened layer was 40 to 80 μm, and the depth of the nitrogen diffusion layer from the surface of the outer hardened layer was 2 to 5 μm. In addition, each of Nos. 1 to 9 had a fatigue strength of 450 MPa, and the evaluation on wear resistance was O.

All the microstructure of Nos. 1 to 9 had acicular structures. In addition, the width of acicular α phases included in each of Nos. 1 to 9 was smaller than 3 μm.

Nos. 1 to 7 were of the case where cooling was performed after the solution treatment at a cooling rate within a range of 1 to 4° C./s, and the width of acicular α phases was 1 μm or smaller. Each of Nos. 1 to 7 had a fatigue strength of 480 MPa or higher because the width of acicular α phases was 1 μm or smaller. No. 8 was of the case where the cooling rate after the solution treatment was 0.8° C./s that was rather low, and the width of acicular α phases was 1.2 μm. No. 9 was of the case where cooling was performed after the solution treatment at 0.1° C./s, and the width of acicular α phases was 2.5 μm. From the results of Nos. 1 to 9, it is found that the cooling rate after the solution treatment is preferably 1° C./s or higher to obtain a microstructure of the base metal portion having a width of acicular α phases of 1 μm or smaller.

Nos. 10 to 13 were comparative examples in which cooling was performed after the solution treatment at a cooling rate of 1° C./s or higher, the previous stage heat treatment was performed in the ambient air atmosphere, and the subsequent stage heat treatment was performed in the nitrogen atmosphere. No. 10 was an example in which the temperature for the previous stage heat treatment was as low as 620° C., No. 11 was an example in which the temperature for the subsequent stage heat treatment was as low as 670° C., No. 12 was an example in which the time for the subsequent stage heat treatment was as short as 15 minutes (0.25 h), and No. 13 was an example in which the time for the subsequent stage heat treatment was as short as 30 minutes (0.5 h).

As to Nos. 10, 11, and 13, the cross sectional hardnesses at a position 15 μm from the surface fell out of the range of the present invention, and the evaluation wear resistance was rejected. As to Nos. 12 and 13, the cross sectional hardness at a position 5 μm from the surface fell out of the range of the present invention, and the fatigue strength did not reach the intended 450 MPa.

Nos. 14 and 15 were of the case where the previous stage heat treatment was performed in the ambient air atmosphere and the subsequent stage heat treatment was performed in the nitrogen atmosphere. No. 14 showed a depth of the nitrogen diffusion layer falling out of the range of the present invention, and No. 15 shows a depth of the oxygen diffusion layer falling out of the range of the present invention. No. 14 showed an insufficient fatigue strength, and No. 15 showed an insufficient wear resistance.

No. 16 was of the case where the previous stage heat treatment was performed in the ambient air atmosphere, No. 17 was of the case where the previous stage heat treatment was performed in the nitrogen atmosphere, and both are of the case where the subsequent stage heat treatment was not performed. No. 16 showed a hardness of the outer-layer portion falling out of the range of the present invention and showed an insufficient fatigue strength. No. 17 showed a nitrogen penetration depth and a hardness of the outer-layer portion falling out of the ranges of the present invention, and showed an insufficient wear resistance.

No. 18 was of the case where the previous stage heat treatment was performed in the ambient air atmosphere, and the subsequent stage heat treatment was performed in the vacuum atmosphere. The nitrogen diffusion layer was not formed, and the fatigue strength was insufficient. No. 19 was of the case where the previous stage and subsequent stage heat treatments were performed in the nitrogen atmosphere. The nitrogen diffusion depth fell out of the range of the present invention, and the fatigue strength was insufficient.

Experimental Example 2

Titanium alloys having alloy compositions shown in Table 2 were melted using the vacuum arc remelting (VAR) method, and subjected to forging and heat rolling, so that a barstock of ϕ15 mm was manufactured. The obtained barstock was subjected to solution treatment in which the barstock was heated in the ambient air at 1050° C. for 20 minutes, and subjected to air cooling at temperatures of from 1050 to 700° C. at a cooling rate of 2° C./s on average, so that the microstructure of a base metal portion is developed. The cooling rate after the solution treatment is calculated using the temperature of a cross-sectional center portion measured with a thermocouple in a hole having a diameter of 2 mm opened in the barstock.

From the barstock having the microstructure developed in such a manner, fatigue test specimens each including a parallel portion of ϕ4 mm×8 mm length and flat plate specimens having dimensions of 2 mm×10 mm×10 mm were fabricated, and the parallel portions of the fatigue test specimens and the surface of the flat plate specimens were abraded with #1000. Subsequently, the fatigue test specimens and the flat plate specimens were subjected to the previous stage heat treatment in the ambient air atmosphere and the subsequent stage heat treatment in the nitrogen atmosphere in this order under conditions shown in Table 2, so that an outer hardened layer was formed on the entire surface of an outer layer of each fatigue test specimen and flat plate specimen.

Subsequently, as in the experimental example 1, hardnesses of the base metal portion and the outer hardened layer, a fatigue strength, an abrasive resistance, a microstructure, and a width of acicular α phases were measured for each fatigue test specimen. In addition, using a GDS, the depths of the oxygen diffusion layer and the nitrogen diffusion layer of each flat plate specimen were determined.

Table 2 shows chemical compositions of the alloys, temperatures and times for the previous stage heat treatment and the subsequent stage heat treatment, the cross sectional hardnesses at positions 5 μm and 15 μm from the surface of the base metal portion, depths of the oxygen diffusion layer and the nitrogen diffusion layer, and the results of evaluations on fatigue strength, wear resistance, microstructure, and the width of acicular α phases.

TABLE 2

| | CHEMICAL COMPOSITION (MASS FL BALANCE Ti AND IMPURITIES) | | | | | | | PREVIOUS STAGE HEAT TREAT-MENT | | SUBSEQUENT STAGE HEAT TREAT-MENT | |
|---|---|---|---|---|---|---|---|---|---|---|---|
| | Al | Mb | V | Cu | Fe | O | Mo EQUI-VALENT | TEMP. ° C. | TIME h | TEMP. ° C. | TIME h |
| 10 | 4.5 | 3.0 | 3.0 | | 2.0 | 0.12 | 10.0 | 780 | 0.5 | 750 | 4 |
| 11 | 5.0 | 3.0 | | 2.0 | 1.0 | 0.24 | 8.0 | 780 | 0.5 | 750 | 4 |
| 12 | 5.5 | 2.0 | 3.0 | 2.0 | | 0.16 | 6.5 | 780 | 0.5 | 750 | 4 |
| 13 | 6.0 | 6.0 | | | 3.0 | 0.06 | 13.5 | 750 | 1 | 750 | 4 |
| 14 | 5.0 | 2.0 | | | 2.0 | 0.26 | 7.0 | 750 | 1 | 750 | 3 |
| 15 | 4.0 | 5.0 | | | 2.5 | 0.18 | 11.3 | 850 | 0.13 | 800 | 1 |

| | BASE METAL POR-TION HARD-NESS HV | NEAR-SURFACE PORTION HARD-NESS 5 μm HV | NEAR-SURFACE PORTION HARD-NESS 15 μm HV | OXYGEN DIFF-USION DEPTH μm | NITRO-GEN DIFF-USION DEPTH μm | MICRO STRUC-TURE | WIDTH OF ACIC-ULAR PHASE μm | FATIGUE STRENGTH MPa | WEAR RESIS-TANCE | NOTE |
|---|---|---|---|---|---|---|---|---|---|---|
| 10 | 340 | 580 | 450 | 65 | 5.2 | ACICULAR | 0.7 | 460 | ○ | INVEN-TIVE EXAM-PLE |
| 11 | 390 | 580 | 490 | 63 | 5.1 | ACICULAR | 0.9 | 520 | ○ | |
| 12 | 355 | 550 | 460 | 60 | 4.8 | ACICULAR | 1.0 | 480 | ○ | |
| 13 | 375 | 550 | 480 | 61 | 4.9 | ACICULAR | 0.7 | 500 | ○ | |
| 14 | 360 | 520 | 460 | 53 | 4.5 | ACICULAR | 0.9 | 490 | ○ | |
| 15 | 370 | 550 | 455 | 57 | 4.8 | ACICULAR | — | 640 | ○ | |

No. 10 was an example of containing 3.0% of V, in which the Mo equivalent was 10.0%, and No. 11 was an example of containing 2.0% of Cr, in which the Mo equivalent was 8.0%. Both had hardnesses of the regions falling within the ranges of the present invention, and showed good fatigue strength and wear resistance. No. 12 was an example of containing V and Cr, but not containing Fe, in which the Mo equivalent was 6.5%. The hardnesses of the regions fell within the ranges of the present invention, and the fatigue strength and the wear resistance were both good. No. 13 was an example in which the Mo equivalent was as high as 13.5%, and No. 14 was an example in which the oxygen concentration was as high as 0.26%. Both had hardnesses of the regions falling within the ranges of the present invention, and showed good fatigue strength and wear resistance. No. 15 was an example in which the microstructure was an equiaxed structure having a particle size of 5 μm. The fatigue strength was 540 MPa that fell within an acceptable range, and the wear resistance was also good.

The invention claimed is:

1. A titanium alloy member comprising a base metal portion, and an outer hardened layer formed on an outer layer of the base metal portion, the base metal portion having a cross sectional hardness of 330 HV or higher and lower than 400 HV, wherein a microstructure of the base metal portion is an acicular structure including an acicular α phase precipitating in a β phase matrix and a grain boundary α phase precipitating along a crystal grain boundary of prior β phases, cross sectional hardnesses at positions 5 μm and 15 μm from a surface of the outer hardened layer being 450 HV or higher and lower than 600 HV, the outer hardened layer including an oxygen diffusion layer and a nitrogen diffusion layer, the oxygen diffusion layer being at a depth of 40 to 80 μm from the surface of the outer hardened layer, and the nitrogen diffusion layer being at a depth of 2 to 5 μm from the surface of the outer hardened layer.

2. The titanium alloy member according to claim 1, wherein the base metal portion is made of a Near-β titanium alloy, and a chemical composition of the base metal portion contains, in mass %, Al: 3 to 6%, oxygen: 0.06% or more and less than 0.25%, Mo equivalent of 6 to 13%, which is calculated by a following formula (1), with the balance being Ti and impurities:

$$\text{Mo equivalent (\%)} = \text{Mo (\%)} + \text{V (\%)}/1.5 + 1.25 \times \text{Cr (\%)} + 2.5 \times \text{Fe (\%)} \quad (1)$$

where symbols of elements in the formula (1) indicate contents of respective elements in mass %.

3. The titanium alloy member according to claim 1, wherein the titanium alloy member is a member for an automobile.

4. The titanium alloy member according to claim 2, wherein the titanium alloy member is a member for an automobile.

5. A method for manufacturing the titanium alloy member according to claim 1, comprising:

a) shaping the base metal portion into a shape;

b) heat-treating the base metal portion by performing a first stage heat treatment in an oxygen-containing atmosphere at 650 to 850° C. for 5 minutes to 12 hours;

c) further performing a second stage heat treatment in a nitrogen atmosphere at 700 to 830° C. for 1 to 8 hours.

* * * * *